United States Patent [19]

Guilhem

[11] Patent Number: 4,732,097

[45] Date of Patent: Mar. 22, 1988

[54] PROCESS FOR SEWING AND FOLDING A FLEXIBLE WORK PIECE

[76] Inventor: Christian Guilhem, Route Nationale 20, 82350 Albias, France

[21] Appl. No.: 932,178

[22] Filed: Nov. 18, 1986

[30] Foreign Application Priority Data

Nov. 20, 1985 [FR] France ..... 85 17743

[51] Int. Cl.[4] ..... D05B 97/00

[52] U.S. Cl. ..... 112/269.1; 2/274; 29/91; 29/91.5; 112/441

[58] Field of Search ..... 112/269.1, 268.1, 267.1, 112/262.1, 162, 441; 2/275, 274, 244; 29/91, 91.1, 91.5

[56] References Cited

U.S. PATENT DOCUMENTS

| | | | |
|---|---|---|---|
| 726,311 | 4/1903 | Klemm | 112/269.1 |
| 1,717,075 | 6/1929 | Thenoux | 112/269.1 |
| 2,946,069 | 7/1960 | Bozza | 2/274 X |
| 3,424,161 | 1/1969 | Scheier | 112/441 X |

FOREIGN PATENT DOCUMENTS

| | | | |
|---|---|---|---|
| 24964 | of 1906 | United Kingdom | 112/269.1 |
| 21028 | of 1908 | United Kingdom | 112/269.1 |

*Primary Examiner*—H. Hampton Hunter
*Attorney, Agent, or Firm*—Harold H. Dutton, Jr.

[57] ABSTRACT

The invention concerns a process for folding a flexible piece, in particular to upholster an object such as chair fitting with a flexible cover. The upholstering or covering process comprises cutting out a flexible piece (25) to a shape corresponding to that of the object plus a border on its contour, providing the edge of this border with a tensioning thread sliding within a passage preserved by auxiliary threads, covering the object with the piece so that the border provided with the tensioning thread project beyond the object contour, folding back the border and applying tractions in opposite directions on the two ends (5*a*, 5*b*) of the tensioning thread to tighten and to fold this border, lastly, after the tractions have been applied, locking the ends of the tensioning thread either by tieing them together or by stapling them to the back of the object or by crushing a punched-out clip (31) on the back of the object.

13 Claims, 22 Drawing Figures

PROCESS FOR SEWING AND FOLDING A FLEXIBLE WORK PIECE

The invention relates to a process for folding a flexible piece, for instance a textile, and its application to upholstering or covering of objects with flexible covers, in particular chair fittings to serve as backrests, seats or armrests. The invention also relates to products obtained by implementing the process, as well as specially designed or modified means to allow this implementation: a modified sewing machine, an automated cladding process, a manual implement for carrying out the process.

BACKGROUND AND OBJECTS OF THE INVENTION

Chair fittings generally comprise a rigid support of appropriate shape and an elastic layer, particularly of foam, which is kept on the front side of this support by a cover. The rigid support generally is wood or plastic (or similar material), though it may also be metal.

At the present time the covers are made of fabrics cut to the shape of the fittings with a very wide margin at the periphery. This margin allows gripping each cover by its edges, folding it along the periphery of the fitting and applying a traction for assuring placement of the cover around its fitting. The margin then is fixed on the solid support either at its back or on its periphery. When the support is wood, this fixing is generally carried out by stapling the fabric on the support. In case of a metal support, this fatening is carried out by a clip which is bent at the edge of the fitting to clamp the fabric margin.

This covering procedure incurs significant drawbacks. In the first place, the process requires extensive labor to carry out the manual operation of putting the cover in place by consecutive tractions, and fastening it by stapling or by clips. In the case of a metal support, these operations not only are lengthy, but furthermore delicate, requiring great skill. Also, the substantial width of the borders required on the periphery of each piece of fabric entails substantial losses in material over what would be actually necessary to cover the fitting. Very often these borders must be made extra large to eliminate the floating fabric strip, and this operation both increases labor costs and the danger of fraying the fabric edges which would be detrimental to the final product appearance. Further, the folds of the cover along the fitting periphery often are irregularly distributed and following fixation it is difficult to change them to improve the appearance of the finished product.

Furthermore, as regards some fittings, the cover fixation is carried out within a recess along the periphery of its rigid support. For a wooden support, fixation is by stapling with a fine stapling gun, and this operation also is lengthy and costly in labor.

One object of the present invention is to overcome the above drawbacks and to provide a process for upholstering or cladding objects at considerable saving in labor.

Another object is to make possible substantial savings in materils.

Another object is to produce a finished product with improved appearance.

In general the purpose of the invention is to provide an improved folding process for a flexible, in particular textile piece, applicable within the above stated scope of cladding objects or any other field.

DESCRIPTION OF THE INVENTION

To that end the folding process is characterized in that it comprises in combination: inserting into the edge of the piece, at least one auxiliary thread so as to preserve a passage along that edge, placing a tensioning thread within that passage in such a manner as to slide inside and along the passage while projecting therefrom at both ends, and exerting on both ends of the tensioning thread tractile forces in opposite directions to shorten the length of the thread within the said passage and to tighten the piece material.

In a preferred embodiment of the invention, the auxiliary threads are stitched in such a manner that they form an overcast at the edge of the piece, and the tensioning thread is continuously put in place simultaneously with the stitching as this stitching takes place.

The tensioning thread and the two auxiliary threads retaining tand guiding it can be directly placed on the piece to be folded or, on the contrary, they can be put on an auxiliary ribbon which then is fastened, in particular by plain sewing, at the edge of the piece which is to be folded.

It should be emphasized that the process of the invention offers pronounced advantages over the folding methods used in the garment industry; in that field, folding is carried out using a hem into which is slipped the tensioning thread. However it is difficult to make this hem, which involves folding and turning back the fabric edge and sewing it together, where the parts are other that straight, and in practice it is impossible where strong curvatures are encountered unless there is a clamping of the tensioning thread (especially at angles). Further, a hem entails two superposed thicknesses, sometimes three, whereas the process of this invention allows folding while retaining a single thickness at the edge of the textile piece.

It should be noted that the process of the invention also is advantageous in the above manner with respect to another folding method widely used to fold curtains (this technique comprises providing the border of the fabric piece with a pleated braid comprising a band crossed from one end to the other by a narrower ribbon).

The invention furthermore applies to a modified sewing machine for enabling the implementation of the above defined process. This machine is of the well known type comprising a presser foot, at least one needle, at least one shuttle, drive means for these components and means for feeding auxiliary threads in order to make overcast stitches; in the present invention, this machine is provided with tensioning-thread supply means, means for guiding the thread toward the presser foot and with a guide duct extending longitudinally in the presser foot into which it opens, the duct being positioned transversely to the foot, needle and hooks so as to guide the tensioning thread between the stitching line and the hook-up line of the overcast.

In this manner the tensioning thread is made to unwind continuously and is guided toward the presser foot to align it at the border of the piece, with the overcast being made on either side of it.

Such an ecomomical modification of the overcasting machine makes it possible to place automatically the tensioning thread at the edge of the fabric pieces (or of the ribbons if passing through an auxiliary ribbon).

The invention further extends to an implement for facilitating the traction application to the ends of the tensioning thread. This implement is characterized by comprising a support, two rotary studs mounted on the support, thread clamping means on each stud, a manual rotation drive member and a transmission mechanism between the drive member and the rotary studs for assuring their opposite rotation by means of a rotation of the manual drive member.

The invention furthermore relates to and includes a ribbon comprising an accessory for carrying out the above defined folding procedure, this ribbon being characterized by comprising a tensioning thread along it, the tensioning thread being retained by auxiliary threads stitched on the ribbon to allow it to slide longitudinally.

The process of the invention may be applied for covering an object so as to clad it on its front surface. The cladding or upholstering process of this application is characterized in that it comprises in combination: cutting out a flexible piece of material, the shape of which corresponds to the front side of the object plus an additional border at the contour; stitching this border along the edges of the piece with at least one auxiliary thread arranged to preserve a passage extending along the border, and placing a tensioning thread into the passage so it can slide within and along this passage while extra lengths project at its two ends; covering the front side of the object with the piece so that the border having the tensioning thread projects beyond the contour of the object; folding back the border at the edge of the object and applying opposite traction force to the two ends of the tensioning thread so as to shorten the length of the thread within the above passage and tightening and folding the border; and locking in place the ends of the tensioning thread after the tensioning thereof.

This process also is applicable both to cover the edge of which must be placed in back of an object, i.e. on its back side, and to a cover the edge of which must be inserted into a recess along the object periphery. In the first case the border with the tensioning thread is folded back toward the back side of the object, then the thread is tightened near the back side when the tractions are applied. In the second case, the tensioning thread is positioned so as to be opposite the recess following the folding back of the border and is tightened for insertion into the recess.

In the process of the invention, the border may be provided with a width rigorously no more than required because it is no longer necessary to grip it to pull on the fabric and bacause it no longer is used to fix the fabric on the object. On the contrary, now it is the ends of the tensioning thread which are pulled and the fabric is kept in place by tightening this thread behind or around the object. In this manner a more defined cut-out of the pieces makes possible savings in material. Further, no over-sizing at all is required, and the overcast fabric edge presents a perfect look which provides the finished product with the appearance of quality. Again, the cover is not locked in place along the object periphery as would be the case if stapled, fused, glued or fixed by ribbon. After the ends of the tensioning thread have been tightened, where called for the operator may distribute the folds by circumferentially slipping the border along the tensioning thread.

This cladding process of the invention is particularly applicable to making chair fittings comprising a rigid support and an elastic layer (foam or other). The process provides substantial economies in labor. It should be further noted that in this case, the piece cut-out operation is easily matched to the fitting contour to obtain the desired final shape following tensioning.

The ends of the tensioning thread may be tightened by any means and in particular by a knot solidly joining them. As regards wood or analoguous supports, these ends may be stapled into the back of the fitting or into the recess of its periphery. For metal supports, it is advantageous to provide the support with at least one stud projecting where the ends of the tensioning thread are located; in that case the ends of this tensioning thread are tightened by closing the stud(s) on the support to clamp the ends.

The tensioning thread may be of any kind suitable for the application. In some cases this may be an electrically conducting wire of which one projecting end is fastened to a metal part of the chair to eliminate electrostatic charges.

To facilitate cladding an angular fitting, the rigid fitting support preferably is manufactured to comprise on its back side at least one pin near each angle. The tensioning thread then is tightened to come to rest against these pins in order to better spread the clamping effect and to restrict it to the sites of the angles.

The above defined fitting cladding process in particular can be carried out on a press comprising a table, a movable compression plate opposite the table, means displacing the plate to move it toward or away from the table, and a form with raised edges keeping the fitting in place and supported by the table. In a feature of the present invention, the press is equipped on two sides of, and near the table, with claws gripping the ends of the tensioning thread mutually opposite and mounted on actuators which move them toward or away from each other in a plane substantially parallel to that of the table in order to exert a traction on the ends of the tensioning thread.

Such a press allows cladding chair fittings with remarkable savings in labor.

The present invention also relates to completed chair fittings with a rigid support, an elastic layer, a flexible cover on one side of the fitting and with a border folded back along the rim of that side or toward the opposite side, characterized in that the cover is kept in place by a tensioning thread retained by auxiliary threads stitched along the above border, the tensioning thread being stretched and locked in position so as to fold the border and tighten it along the periphery of the fitting or toward the back side.

Other features, purposes and advantages of the invention will become clear from the description below in relation to the drawings showing illustrative, non-restrictive embodiments and being an integral part of the application.

DESCRIPTION OF THE PREFERRED EMBODIMENTS

Figure 1:
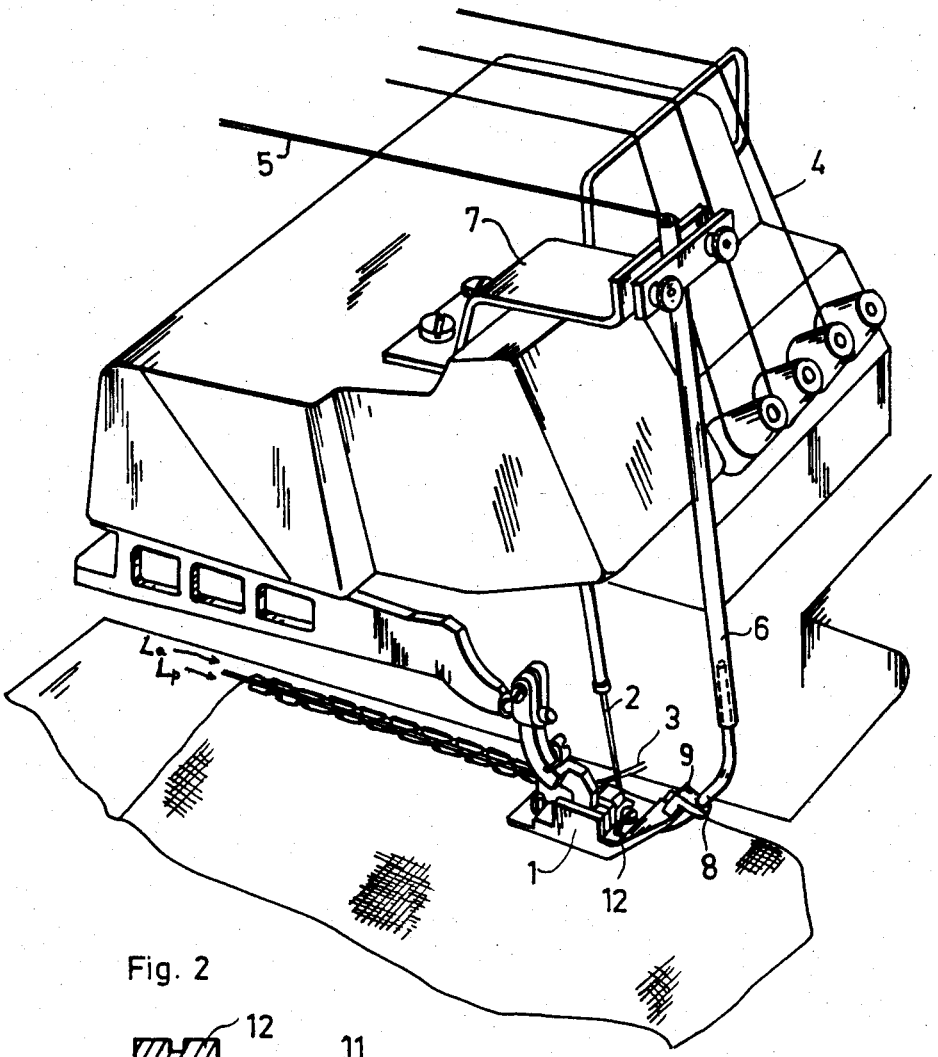
FIG. 1 is a schematic perspective view of a sewing machine modified in accordance with the invention.
Figure 2:
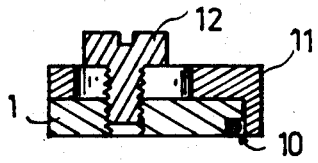
FIG. 2 is a cross-sectional detail view of the presser foot.
Figure 3:
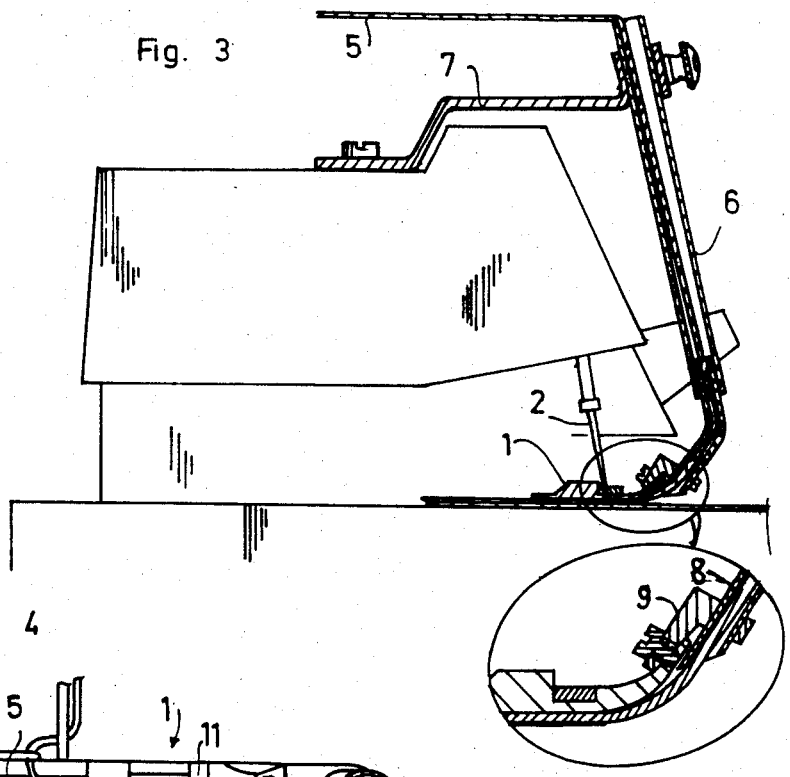
FIG. 3 is a schematic sectional view.

The sewing machine illustratively shown in FIGS. 1, 2 and 3 is a conventional overcasting machine with a presser foot 1, a needle 2 (or, where called for, several needles) and guide hooks (two in this example) of which one is shown at 3 in FIG. 1. These means are associated with supplies of auxiliary threads 4 and with conventional drive means displacing them in suitable manner to make overcast stitches. In FIG. 1, it is assumed that the machine is fed with three auxiliary threads 4 to make a triple thread overcast: two of these threads are worked by the two guide hooks 3 in order to snake on both sides by jointly hooking themselves along a hook-up line La near the edge of the fabric piece, the other thread is worked by the needle 2 to make a stitch line Lp through the material to keep the two other threads in place.

These means and their operation are well known per se and will not be described herein in further detail.

According to the present invention, the sewing machine is provided with a spool feeding a supplementary thread called the tensioning thread 5 and with a larger diameter than the auxiliary threads 4 (the particular supply spool is conventional and omitted from the drawing).

Moreover a substantially vertical tube 6 is mounted to the front of the machine by a bracket 7. This tube is designed to guide the tensioning thread from the supply spool to the vicinity of the presser foot 1 opposite the upstream part of this foot.

A flexible tube 8 having a lesser diameter than tube 6 is solidly joined to the presser foot 1 by an adapter 9 so that one of its ends enters the rigid tube 6.

The other end of this flexible tube 8 is opposite duct 10 extending longitudinally in the presser foot so as issue from underneath it. The flexible tube 8 thereby forms a continuous passage between the rigid tube 6 and the duct 120 and its flexibility accommodates the motions of the presser foot.

The duct 10 is formed by a groove arranged under the presser foot and at the edge thereof; this groove is closed laterally by an angled part 11 fixed on the presser foot by a screw 12. In this manner the duct is positioned transversely to the presser foot, the needle and the guide hooks to guide the tensioning thread 5 at a level in-between the stitching line Pq and the hook-up line Pa of the overcast.

Figure 4:
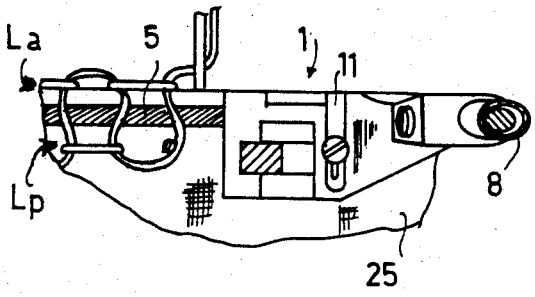
FIG. 4 is a detail view illustrating the operation of the machine.
Figure 5:
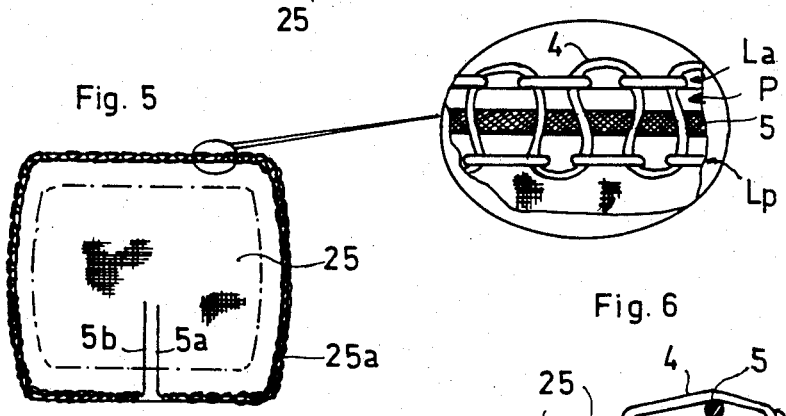
FIG. 5 is a schematic view of a cover made by the machine for covering a chair fitting.
Figure 6:
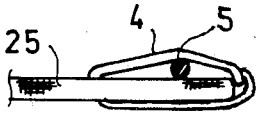
FIG. 6 illustrates a detailed sectional view of the structure of the edge of the covering.

As illustrated in FIGS. 4, 5 and 6, the tensioning thread unwinds continuously and is guided to align itself with the edge of the fabric piece (denoted by 25 in these figures) so that overcasting takes place above the thread 5 and traps it in the longitudinal passage P preserved between the stitching line Pq and the hook-up line Pa. The tensioning thread 5 remains free to slide longitudinally within this passage. It should be noted that no difficulty at all arises at the angles: it is enough to turn the fabric piece conventionally in relation to the sewing machine.

When the overcast has been made along the entire edge of the piece of fabric, the tensioning thread is cut so as to leave excess lengths 5*a*, 5*b* at its two ends (FIG. 5).

The fabric piece may then be folded by applying opposite tractions to these excess lengths in order to shorten the length within the above passage.

In the example of FIG. 5 the fabric piece is provided directly with the tensioning thread 5 by directly stitching the auxiliary threads into the material of this piece while simultaneously putting in place the tensioning thread.

Figure 7:
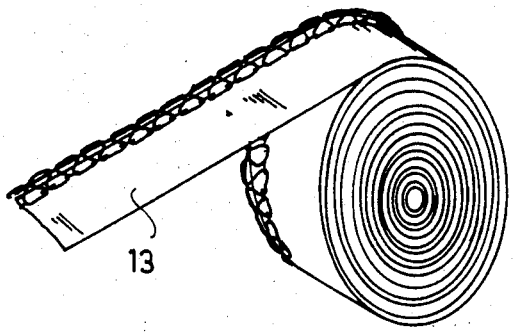
FIG. 7 is a schematic view in perspective of an auxiliary ribbon made according to the invention using the machine.

It is also possible to use an auxiliary ribbon 13 such as shown in FIG. 7. This ribbon comprises at its edge a tensioning thread running along the length thereof; this tension thread is kept in place as before by auxiliary threads stitched by the above described sewing machine.

Accordingly, ribbons such as 13 may be made available to users so they need not acquire a modified overcasting machine; a simple conventional sewing machine then suffices to stitch the ribbon to the edge of the particular fabric piece.

Folding a fabric piece 25 provided with a tensioning thread as explained above is described below within the scope of the process for cladding a chair fitting.

Figure 8:
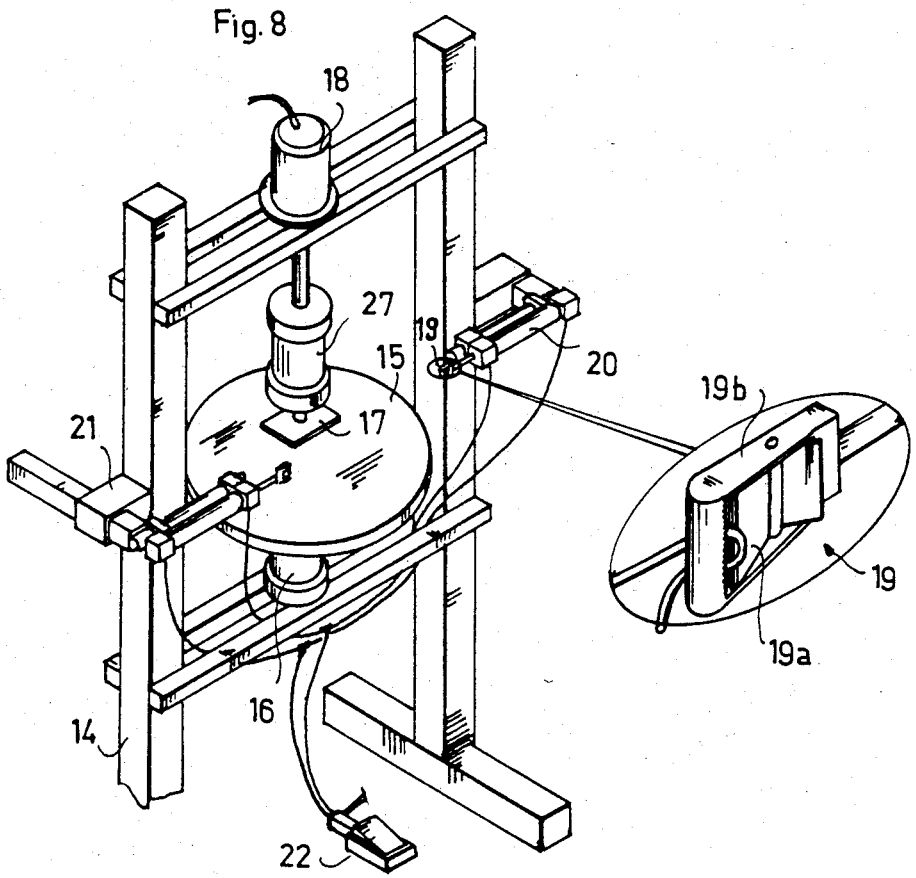
FIG. 8 is a schematic view in perspective of a cladding press of the invention.

This folding and this cladding are carried out using a press such as shown in FIG. 8.

The press comprises a frame 14 with a horizontal table 15 which in this instance is circular. This table is mounted on pivot means such as thrust ball bearings 16, which permit its rotation about a central axis perpendicular to its plane (in this instance a vertical axis).

A movable compression plate 17 is mounted above the table 15 and rests in an actuator 18 so it can be vertically displaced opposite the table; in the same manner as for the table, pivot means such as thrust bearing 27 are interposed to permit rotation of the plate around the same vertical axis as the table.

The press furthermore includes grippers such as 19 on both sides of and above the table. In this example each gripper 19 is known per se and comprises a locking plate 19*a* with a serrated forward ridge articulating in a frame 19*b*; in this manner it may lock one thread end entering the gripper as shown in detail in FIG. 8.

The two grippers 19 are mutually opposite and are mounted on double-acting actuators 20 which can move them closer together or apart in a plane substantially parallel to that of the table. Preferably these actuators are fixed on supports 21 allowing adjustment of their positions in relation to the kind of fitting to be clad.

In this example the actuators 20 are pneumatic and controlled in synchronized manner by a pedal 22.

FIGS. 9*a* through 9*e* show the process being implemented using the cladding press.

A holding form 23 is set at the center of the table 15 and comprises raised edges 23*a*, and its shape is matched to that of the fitting 24 to be clad.

This fitting 24 comprises a rigid support 24*a* and an elastic foam layer 24*b*. Its cover 25 comprises a fabric piece of the type shown in FIG. 5. This piece was previously cut to fit the shape of the fitting plus a border 25*a* and is therefore provided with the tensioning thread 5 at the edge of this border.

Figure 9A:
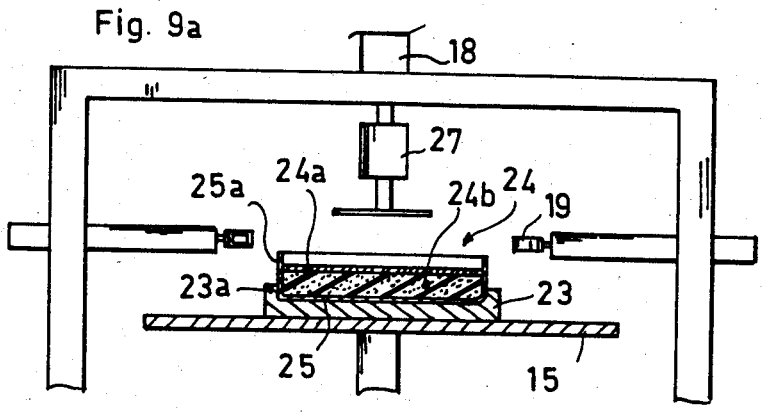
FIGS. 9*a*, 9*b*, 9*c*, 9*d*, and 9*e* are schematic views illustrating the upholstering process of the invention.

The fabric piece 25, the foam layer 24*b* and the rigid support 24*a* are superposed inside the form 23 as shown in FIG. 9*a*, the border 25*a* of the piece being raised by the form edges 23*a*. The operator rotates the table 15 to place the two ends of the tensioning thread next to the grippers 19.

Figure 9B:
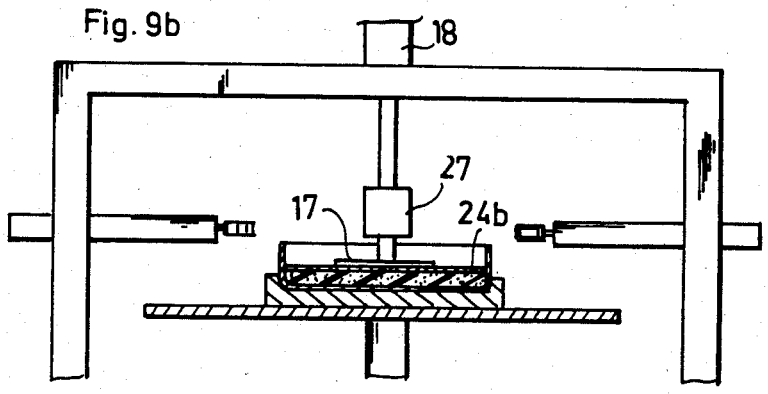
Figure 9C:
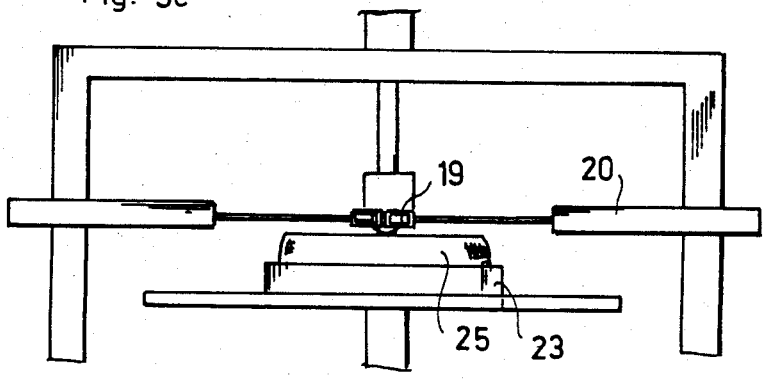

Thereupon the actuator 18 lowers the plate 17 until the elastic layer 24*b* is compressed (FIG. 9*b*).

Thereupon the grippers 19 are moved together (FIG. 9*c*) by their actuators 20. The operator crosses the ends of the tensioning thread to hook each into the opposite gripper.

Figure 9D:
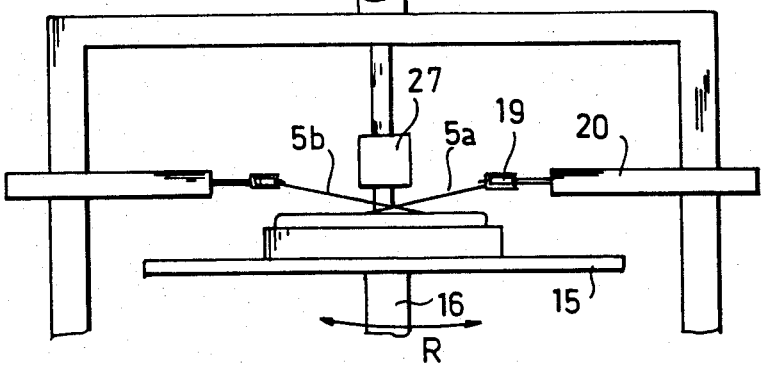

Next the grippers 19 are moved apart by the actuators 20 (FIG. 9*d*). In the course of their motions, the grippers pull on the ends 5*a*, 5*b* so as to tighten and fold the border 25*a* which folds over against the back side of the rigid support. Excellent regular distribution of the folds is achieved by making the plate 15 rotate slightly in both directions (arrow R in FIG. 5*d*: the thrust bearings 16 and 27 allow this rotation in the compressed position).

Figure 9E:
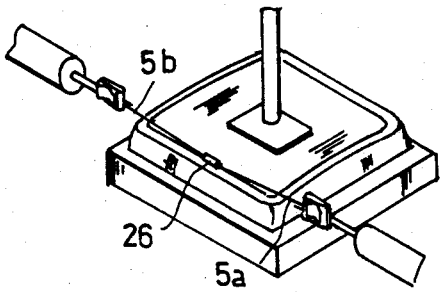

Thereupon the ends of the tensioning thread are locked, for instance by stapling them with a staple 26 to the back of the rigid support if it is wood or the like (FIG. 9*e*). These ends then may be cut off near the staple 26.

The above described process allows labor savings of roughly 50% over the conventional method wherein the cover is manually pulled to the rear of the rigid support and then is fixed along its entire periphery.

Figure 10:
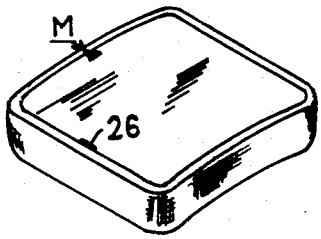
FIG. 10 is a perspective view of a chair fitting made by carrying out the process.

A fitting such as is shown seen from the back in FIG. 10, with remarkable finish qualities. The process of the invention allows leaving only a very narrow border M at the rear of the fitting in order to reduce fabric consumption. Furthermore, the overcast edge of the fabric evinces perfect sharpness without any danger of fraying. Where called for, the peripheral folds of the cover may be displaced in the end to further improve their distribution. Thereafter if desired several staples may be placed on the cover to freeze it in it best position.

The tensioning thread 5 may be of any type: thread, synthetic, natural or possibly also a metallic wire. In the latter case, a projecting length may be left to be ultimately fixed to a metal part of the chair, for instance its foot: in this manner the invention provides a simple way of avoiding static charges building up on this chair.

Figure 11:
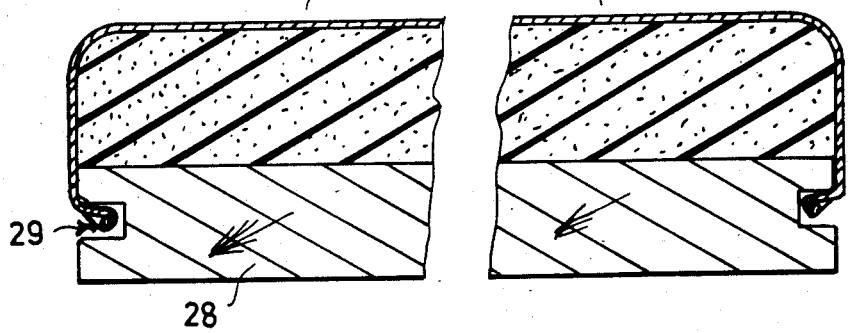
FIG. 11 is a sectional view of a variation of a fitting made by the process of the invention.

FIG. 11 is a cross-section of a fitting similar to the previous one but where the rigid support 28 is provided on edge with channel 29. The cover is such that its tensioning thread positions itself opposite this channel and will tighten within it. The locking of the ends then can be carried out by any means and in particular by a staple if the support is wood or similar.

Figure 12:
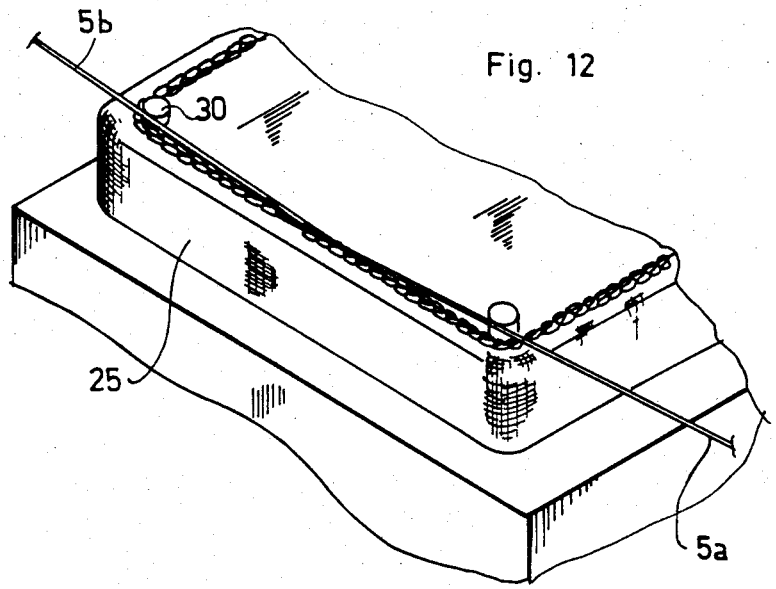
FIG. 12 is a detail view in perspective of another variation.

FIG. 12 is a partial perspective of another variation of the fitting where the rigid support is previously provided, during its manufacture, with a pin 30 projecting from its back side in the vicinity of each angle. This pin may be inserted by nailing, screwing etc. in case of a wood support, or it may be made by a punch-out in the case of a metal support. When the tensioning thread is tightened, it comes to rest against these pins 30 (on the outside) so that the tightening effect is restricted to the zones of the angles. In this manner excessive tension on the fabric piece is avoided where the curvatures are marked.

Figure 13:
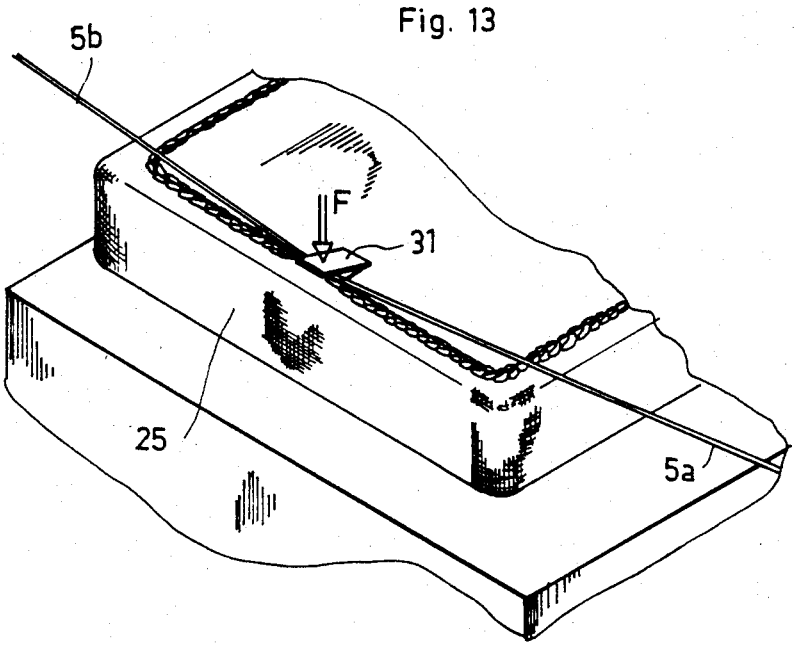
FIG. 13 is a detail view in perspective of another cladding embodiment.

FIG. 13 shows one possible locking mode for the ends of the tensioning thread in the case of a metal support (where a staple cannot be used). During its manufacture this support was provided with one or more punched-out clips 31 projecting at the location of the tensioning thread ends. At the place where the ends cross, the fabric border is made to pass underneath this clip which then is closed down toward the support (arrow F) to clamp the ends after application of the tension.

Figure 14:
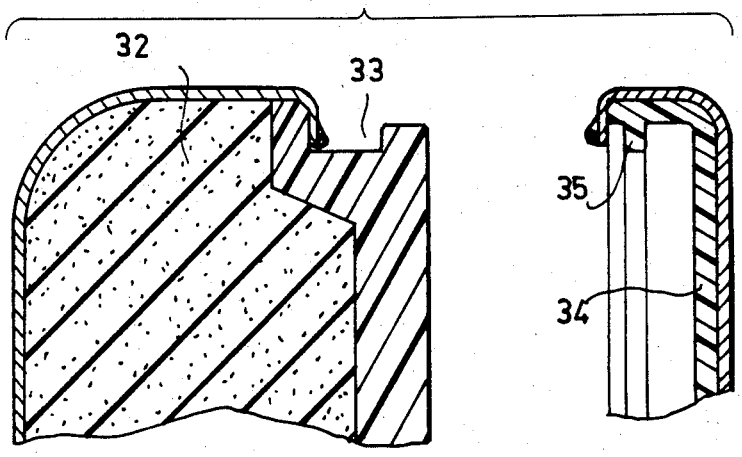
FIGS. 14 and 15 are sectional views of a chair backrest or seat covered according to the invention to its two sides, respectively, before and after assembly.
Figure 15:
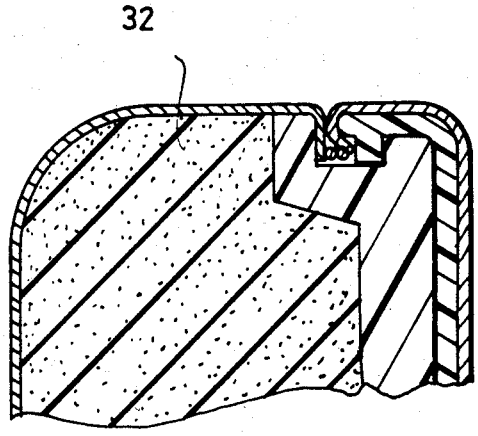

The process of the invention is especially well suited to make chair backrests or seats covered on both sides as schematically indicated by FIGS. 14 and 15. A fitting 32 of the above type comprises a rigid support provided on its periphery with nesting means, in particular a peripherally recessed mold 33; this fitting is covered using the process of the invention, in particular by tightening the tensioning thread of its covering into the mold 33.

A plate 34 provided on its perhiphery with nesting means conjugate to the nesting means of the fitting (in this instance a nesting collar 35 with suitable shape and elasticity) is clad similarly by a covering. The tensioning thread can be tightened by the back side of the nesting collar.

The fitting 32 and the plate 34 then are moved together back to back so that their clad sides are opposite and are nested and crimped by causing their conjugate nesting means to cooperate.

Figure 16:
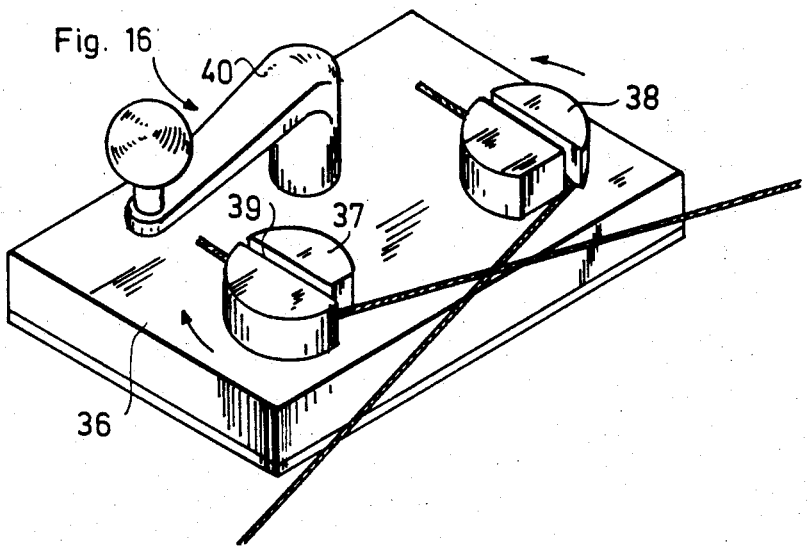
FIGS. 16, 17 and 18 are views of an accessory implement of the invention, respectively in perspective and in section along two perpendicular planes.
Figure 17:
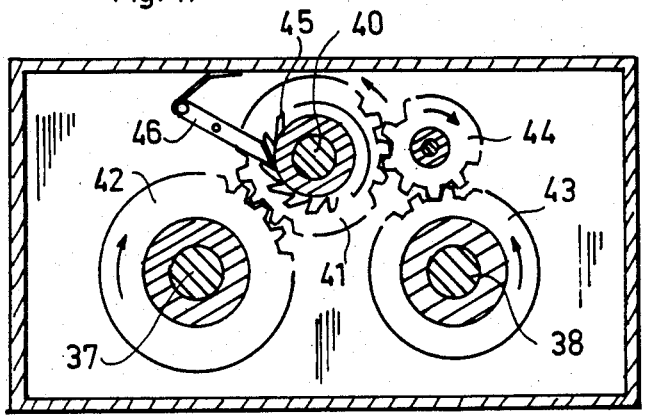
Figure 18:
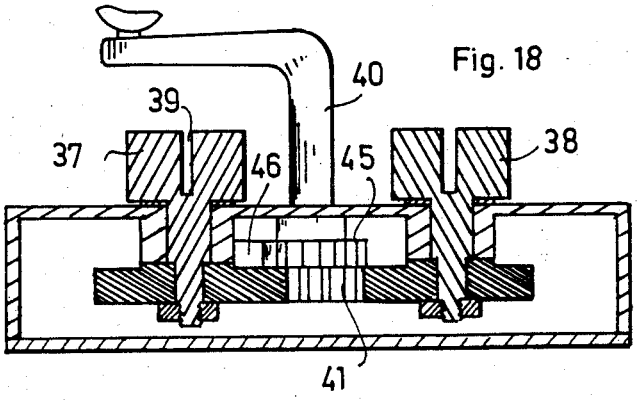

The tractions can be applied to the ends of the tensioning thread for certain application (cladding in a press, or any other fabric folding) using an implement of the type shown in FIGS. 16, 17 and 18.

This compact implement can be handheld and to that end comprises a support 36 for instance in the form of a flat box. Two rotating studs 37, 38 are mounted on this box so as to be mutually opposite. Each stud includes means to clamp one thread end.

In this example each stud comprises a slightly elastic material and these clamping means comprise a mere diametral slot 39 in each stud. Initially the two stud slots are arranged in parallel (or even slightly divergent) planes as shown in FIG. 16, with one face cut into the mutually opposite halves so that the thread ends can be well guided and be perfectly well locked when in their cross positions.

A hand-actuated member such as the handle 40 drives these studs through a transmission mechanism housed within the support 36; this mechanism includes in this example a pinion 41 solidly joined at the handle, a pinion 42 solidly joined to the stud 37 and directly engaging the pinion 41, and a pinion 43 solidly joined to the other stud 38 and engaging an intermediate pinion 44. The two studs 37 adn 38 therefore rotate in opposite directions when the handle itself is rotating. The pinions are sized in such a way that these opposite rotations take place at equal speeds.

A unidirectional member such as the ratchet wheel 45 and the pawl 46 allows rotating the mechanism only in one direction in order to avert a back motion following tractions exerted on the thread ends.

The above described implement allows applying well defined tractions in an effortless and practical manner to the ends of the tensioning thread when this thread is to be tightened to achieved folding.

What is claimed is:

1. A process of covering an object with a flexible cover, said object having a front side to be covered and comprising in combination cutting out a flexible piece (25) having a shape corresponding to that of the front side of the object and an additional border (25*a*) along its contour, stitching into said border (25*a*) at the edge of the piece at least one auxiliary thread (4) in such a manner as to form an overcast at the edge of the piece for providing an overcast passage extending along said border and placing a tensioning thread (5) in said overcast passage between a stitching line (Pq) of the auxiliary threads in the material and an outer line (Pa) hooking up the threads to each other in such a manner that the tensioning thread can slide within and along said passage with thread lengths projecting at both ends (5*a*, 5*b*), covering the front face of the object with the piece in such a manner that the border provided with the tensioning thread extends beyond the object contour, folding back said border at the edge of the object and applying tension to the two ends (5*a*, 5*b*) of the tensioning thread to shorten the length of the tensioning thread within said passage and to tighten and fold said border, and locking the ends of the tensioning thread after tension is applied.

2. A process as in claim 1 and wherein the placing of the tensioning thread (5) is carried out simiultaneously with the stitching of the auxiliary threads (4) by stitching above said tensioning thread and while guiding said tensioning thread along the edge of the piece as stitching proceeds.

3. A process as in claim 2 and including continuously feeding said tensioning thread (5) and guiding said tensioning thread so as to align it at the edge of the piece, and forming said overcast above said tensioning thread so that the stitching (Pq) in the material and the hook-up line (Pa) between the auxiliary threads are located on either side of this tensioning thread.

4. A process as in claim 3 and wherein said tensioning thread (5) is placed directly on the piece to be folded by stitching the auxiliary threads (4) directly into the material of the piece and by placing the tensioning thread (5) in the said passage (P).

5. A process as in claim 3 and wherein said tensioning thread (5) is put in place on an auxiliary ribbon (13), by stitching the auxiliary threads (4) on said ribbon, and by arranging said tensioning thread along said ribbon, fastening said auxiliary ribbon by sewing said ribbon onto the edge of the piece to be folded before the tension is applied to the tensioning thread.

6. A process as in claim 1 and wherein said object has a back face opposite said front face and including positioning said tensioning thread in such a manner that following folding back the border, said tensioning thread will be opposite the back side whereby during application of the tension it will be tightened near said back side.

7. A process as in claim 1 and wherein said object has a periphery including a recess (29) along the contour of the front side, and positioning said tensioning thread in such a manner that it will be located opposite said recess after the border has been folded back, said thread inserting itself into said recess when the tension is applied and being tightened within said recess.

8. A process as in claim 1 and wherein said object comprises a chair fitting including a rigid support (24*a*) and an elastic layer on the front side thereof, and maintaining said elastic layer (24*a*) in a compressed condition while the tension is being applied to the ends (5*a*, 5*b*) of said tensioning thread.

9. A process as in claim 8, wherein said rigid support is made of wood or the like, and including locking the two ends of the tensioning thread to the support by staples (26).

10. A process as in claim 1, wherein said rigid support is metallic and including providing said rigid support with at least one projecting clip (31) at the ends of the tensioning thread, said ends of said tensioning thread being secured in place by closing said clips toward the support to clamp said ends.

11. A process as in claim 8 and including locking the two ends of the tensioning thread by tying said ends together.

12. A process as in claim 8 for covering a chair having corners, and wherein said rigid fitting support includes a plurality of pins (30), one of said pins projecting outwardly near each corner on the back side of said support, and tightening said tensioning thread so as to come to rest against said pins for restricting the tightening effect near the angles.

13. A covering process as in claim 1 and including providing said rigid support on its periphery with nesting means (33), covering a plate (34) with a compressed elastic layer, providing said plate on its periphery with nesting means (35) conjugate with those of its fitting, placing the fitting on the plate back to back so that their covered sides are opposite, causing the nesting means to cooperate, and crimping the assembly.

* * * * *